US008282784B2

(12) United States Patent
Takano et al.

(10) Patent No.: US 8,282,784 B2
(45) Date of Patent: Oct. 9, 2012

(54) PAPER-MAKING SHOE-PRESS BELT

(75) Inventors: Satoshi Takano, Tokyo (JP); Hiroyuki Takamura, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 393 days.

(21) Appl. No.: 12/532,175

(22) PCT Filed: Mar. 14, 2008

(86) PCT No.: PCT/JP2008/054754

§ 371 (c)(1),
(2), (4) Date: Sep. 21, 2009

(87) PCT Pub. No.: WO2008/123026

PCT Pub. Date: Oct. 16, 2008

(65) Prior Publication Data

US 2010/0101746 A1 Apr. 29, 2010

(30) Foreign Application Priority Data

Mar. 22, 2007 (JP) ..... 2007-074956

(51) Int. Cl.
*D21F 3/02* (2006.01)

(52) U.S. Cl. ..... 162/358.4; 162/901; 428/167

(58) Field of Classification Search ..... 162/358.4, 162/901, 358.2, 306, 116, 361, 362; 428/163, 428/167

See application file for complete search history.

(56) References Cited

U.S. PATENT DOCUMENTS 4,482,430 A 11/1984 Majaniemi
4,559,258 A 12/1985 Kiuchi
5,914,007 A 6/1999 Henssler et al.
6,030,503 A * 2/2000 Matuschczyk ..... 162/358.4
6,296,738 B1 10/2001 Ishii
6,929,718 B2 8/2005 Kimura
2005/0112332 A1* 5/2005 Billings et al. ..... 428/167
2005/0126733 A1* 6/2005 Fitzpatrick et al. ..... 162/358.1

(Continued)

FOREIGN PATENT DOCUMENTS

DE 197 52 725 A1 6/1999

(Continued)

OTHER PUBLICATIONS

U.S. Appl. No. 12/744,005, filed May 20, 2010, Takamura.

(Continued)

*Primary Examiner* — Eric Hug
(74) *Attorney, Agent, or Firm* — Oblon, Spivak, McClelland, Maier & Neustadt, L.L.P.

(57) ABSTRACT

Provided is a paper-making machine belt (or a paper-making shoe-press belt), which is excellent in a wet-web water-squeezing property, which is stable in a paper quality (e.g., wet-web smoothness or marking property), and which has little damage (e.g., cracking or wear) of the outer circumference of the belt being used. The paper-making shoe-press belt carries a felt for accepting the squeezed water from the wet-web and has draining grooves extended in the felt-side surface. The paper-making shoe-press belt is characterized in that the draining grooves extended in the felt-side surface have at least two kinds of different groove shapes in the transverse direction (or the CMD direction) of the paper-making machine. The groove shape enables the grooves of two continuous and discontinuous kinds to share the functions thereby to satisfy the improvements in the drainage and in the paper quality and the wet-web surface smoothness at the same time.

11 Claims, 7 Drawing Sheets

(a)

U.S. PATENT DOCUMENTS

| | | | |
|---|---|---|---|
| 2006/0085998 | A1 | 4/2006 | Herman et al. |
| 2006/0266489 | A1 | 11/2006 | Takamura |
| 2007/0256688 | A1 | 11/2007 | Schuster et al. |
| 2007/0256806 | A1 | 11/2007 | Scherb et al. |

FOREIGN PATENT DOCUMENTS

| | | |
|---|---|---|
| JP | 59 54598 | 4/1984 |
| JP | 64 61591 | 3/1989 |
| JP | 2001 98484 | 4/2001 |
| JP | 2004 36015 | 2/2004 |
| JP | 3104830 | 8/2004 |
| JP | 2006 336129 | 12/2006 |
| WO | 2005 049917 | 6/2005 |
| WO | 2005 056281 | 6/2005 |
| WO | 2005 075736 | 8/2005 |

OTHER PUBLICATIONS

Office Action mailed Aug. 26, 2010, in co-pending U.S. Appl. No. 12/530,954.

U.S. Appl. No. 12/530,954, filed Sep. 11, 2009, Takano.

* cited by examiner

Fig. 7-A
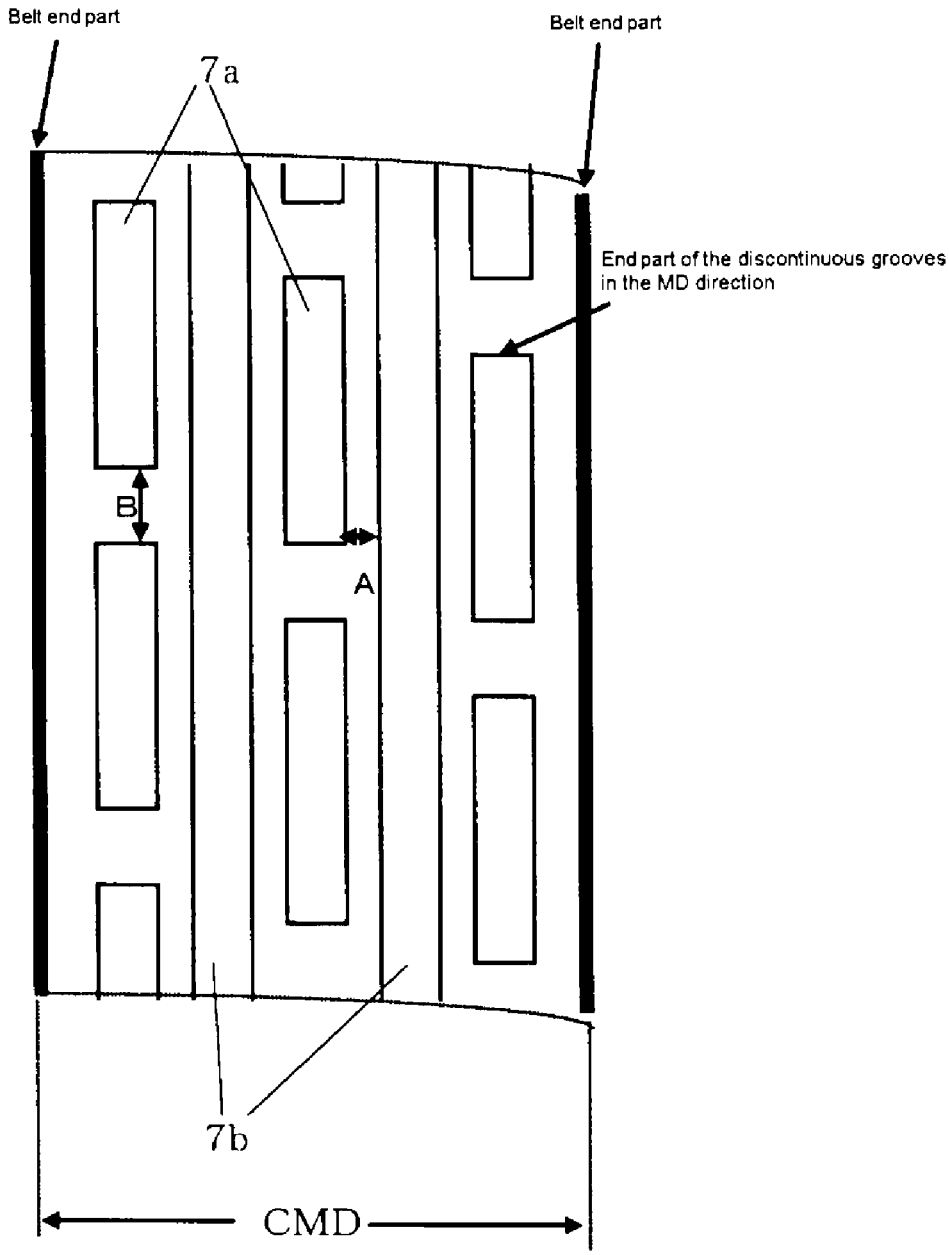
(a)

Fig. 7-b
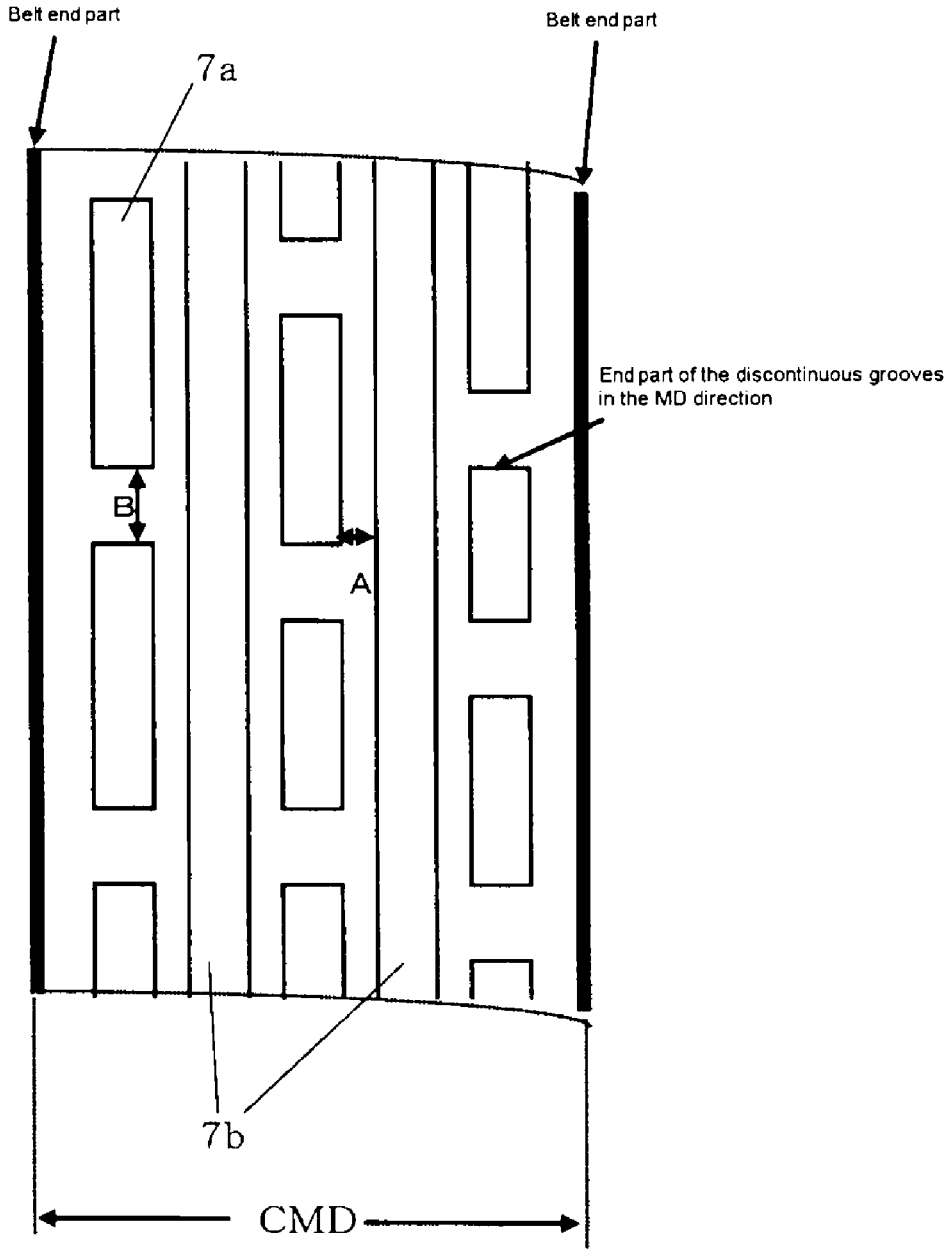
(b)

PAPER-MAKING SHOE-PRESS BELT

FIELD OF THE INVENTION

The present invention relates to a shoe press belt used for improving the capability of water squeezing from a wet paper web and a felt in the press part of a papermaking machine or another similar machine and in particular relates to the groove shape provided along the felt side surface of the shoe press belt.

PRIOR ART

In papermaking, in order to improve productivity, it is a major issue how to increase the dewatering amount from the wet paper web in the press part in which moisture from the wet paper web is removed. As means for increasing the dewatering amount during pressing in order to achieve the object of reducing the moisture in the wet paper web as much as possible, methods such as increasing the pressure applied by the press rolls, increasing the hardness of the press rolls, or extending the time during which the pressure is applied by interposing a shoe press belt and the like are adopted; in recent years, in order to improve the dewatering effect by extending the time during which pressure is applied between the rolls and the felt in the course of pressing, a method in which a shoe press belt is interposed has increasingly come into use.

Moreover, recently examples have increased in which a plurality of grooves is provided along the felt side surface of the shoe press belt in order to efficiently drain the squeezed water. For example, according to Patent document 1, the capability of water squeezing from the wet paper web is improved by providing a plurality of water drain grooves in the external peripheral surface of a belt used in a wide-width nip press (the so-called shoe press).

Most grooves in the prior art have a rectangular shape for reasons of productivity, cost and because they can be easily manufactured, but grooves with a curved groove bottom (Patent documents 2 and 3) and grooves with a concave curved top surface at the space between adjacent water drain grooves (land part) (Patent document 4) have also been proposed. Specifically, Patent document 2 provides a belt with good strength durability and good dewatering capability (water squeezing capability) of the shoe press by forming the groove section in the shape of the letter U, wherein the end parts of the land part of the water drain grooves are chamfered, the groove width is 0.5 to 4 mm, the depth is 0.5 to 5 mm and the land part is 1 to 4 mm. In Patent document 3, besides the curved groove bottom, the side walls of the grooves also curve towards the outside. The press jacket (press belt) according to Patent document 4 has a plurality of webs (land parts) at its external surface, grooves are interposed between these webs, and each web has a concave curved top surface. Patent document 5, moreover, shows a shoe press belt having a plurality of grooves that are substantially discontinued in the machine direction.

The groove shapes of the shoe press belts in the above-mentioned Patent documents have all been fixed at a single shape (groove width, groove depth, land part width, groove number); and the present situation is that, in view of cracks occurring in the internal groove part, damage, wear, transfer marks of the land part, water squeezing capability and the like, a satisfactory shoe press belt cannot necessarily be obtained.

[Patent document 1] Japanese Utility Model Application No. Sho 57-147931 (Utility Model Laid-open No. Sho 59-54598) microfilm

[Patent document 2] Japanese Utility Model Registration No. 3104830

[Patent document 3] Japanese Patent Application Laid-open No. 2001-95484

[Patent document 4] Japanese Patent Application Laid-open No. Sho 64-61591

[Patent document 5] International Patent Publication No. 2005/049917

DISCLOSURE OF THE INVENTION

[Problems to be Solved by the Invention]

The present inventors, having extensively studied the technology in the present field, confronted a situation in which, when a belt with a single shape in which the void volume has been increased is used, there is the tendency that cracks in the internal groove part and damage and wear of the land part easily occur and that, moreover, the paper quality and the smoothness of the wet paper web surface degrade as a result of the pressing (there is an increase in the rate of transfer marks of the groove shape appearing in the wet paper web), and if, on the other hand, the groove width and the groove depth are reduced, the water squeezing capability deteriorates, which in turn results in an increase of the energy consumption for drying the wet paper after pressing.

In consideration of the above-mentioned problems, it is the object of the present invention to provide a belt for a papermaking machine (a shoe press belt for papermaking) which has good water squeezing capability, stable paper quality (smoothness of the wet paper web and marking properties) and wherein damage (cracks and wear) of the external peripheral surface during use is small.

[Means for Solving the Problems]

The present inventors discovered that the above-mentioned problems can be solved by using two types of groove shapes together instead of the one type of groove shape in the prior art and have thus completed the invention. In other words, the present invention relates to a shoe press belt for papermaking having water drain grooves of two types of shape, comprising deep grooves responsible for the water drainage capacity and shallow grooves responsible for the paper quality (surface smoothness of the wet paper web), in the external peripheral surface of the belt.

The present invention basically relates to a shoe press belt for papermaking having water drain grooves of two types of groove shapes and is based on the technologies described hereinafter.

(1) A shoe press belt for papermaking carrying a felt which absorbs the water squeezed from the wet paper web, wherein two or more water drain grooves extend in the machine running direction (MD direction) in the felt side surface of said shoe press belt for papermaking and wherein said two or more water drain grooves comprise at least one continuous groove and at least one discontinuous groove.

(2) A shoe press belt for papermaking according to (1), wherein the two or more water drain grooves have at least two or more types of groove shapes of different groove width and/or groove depth each respectively in the cross machine direction (CMD direction).

(3) A shoe press belt for papermaking according to (1) or (2), wherein the continuous grooves are deep grooves and the discontinuous grooves are shallow grooves.

(4) A shoe press belt for papermaking according to (1) or (2), wherein the continuous grooves are shallow grooves and the discontinuous grooves are deep grooves.

(5) A shoe press belt for papermaking according to (1) or (2), wherein the continuous grooves and the discontinuous grooves have the same groove depth.

(6) A shoe press belt for papermaking according to any one of (1) to (5), wherein the continuous grooves and the discontinuous grooves are substantially provided in alternating parallel rows.

(7) A shoe press belt for papermaking according to any one of (1) to (6), wherein the groove shape is tapered at both end parts of the discontinuous grooves.

(8) A shoe press belt for papermaking according to any one of (1) to (7), wherein the discontinuous grooves are provided in the CMD direction in parallel rows and are arranged at an equal spacing in the MD direction so as to be shifted in relation to each other.

(9) A shoe press belt for papermaking according to any one of (1) to (8), wherein the groove length of the discontinuous grooves is shorter than the width of the press shoe.

(10) A shoe press belt for papermaking according to any one of (1) to (8), wherein the groove length of the discontinuous grooves is equal to the width of the press shoe or within a range of up to two times the width of the press shoe.

(11) A shoe press belt for papermaking according to any one of (1) to (10), wherein the groove depth at one end part of the discontinuous grooves is greater than the groove depth at the other end part.

(12) A shoe press belt for papermaking according to any one of (1) to (11), wherein the groove depth at the central part of the discontinuous grooves is greater than the groove depth of at least one end part.

In the present specification the term discontinuous grooves signifies water drain grooves wherein land parts where grooves are not formed and groove bottom parts where grooves are formed are alternately arranged in the MD direction. Moreover, in the present specification, the term central part of the discontinuous grooves signifies the central part of said groove bottom part in the MD direction, the term end part of the discontinuous grooves signifies the end parts in the MD direction of the same groove bottom part, and the term groove length of the discontinuous grooves signifies the groove length in the MD direction of the groove bottom part. Furthermore, in the present specification, in the case of one end part of the discontinuous grooves and the other end part of the discontinuous grooves as well as in the case of both end parts, respectively, the term end part(s) signifies the end part(s) in the same groove bottom part of the discontinuous grooves.

THE EFFECT OF THE INVENTION

According to the present invention, water drain grooves having at least two types of different groove shapes in the cross machine direction (CMD direction) are provided in parallel rows, wherein said grooves extend in the felt side surface of the above-mentioned shoe press belt for papermaking; therefore, it is possible to attribute the improvement of water drainage capacity and the improvement of the paper quality (surface smoothness of the wet paper web) to the respective groove shape and to provide a shoe press belt for papermaking wherein damage (cracks and wear) of the external peripheral belt surface during use is small.

According to the present invention, it is in particular possible to prevent the reverse flow of water at the nip entrance by configuring the water drain grooves as discontinuous grooves, the water is received below the nip and can be forcibly dewatered by the action of the pressure at the exit, therefore, backwater (reverse flow of water at the nip entrance) does not occur in the low speed region and normal dewatering is possible during pressing.

BRIEF DESCRIPTION OF THE DRAWINGS

FIG. 7-*a* is a plan view showing a third embodiment of the groove shapes according to the present invention.

FIG. 7-*b* is a plan view showing a third embodiment of the groove shapes according to the present invention.

EXPLANATION OF THE SYMBOLS

1: Water drain groove forming device
2: Substrate
3: Roll
4: Polyurethane layer
5: External peripheral surface
6: Groove cutting device
7: Water drain groove
7*a:* Deep groove
7*b:* Shallow groove
8*a:* cutting blade for deep grooves
8*b:* cutting blade for shallow grooves
S: Test specimen
CH: Cramp hand
PR: Press roll
PS: Press shoe
B: Belt
N: Nozzle
W: Water flow
Ft: Top felt
Fb: Bottom felt
WS: Wet paper sheet

PREFERRED EMBODIMENTS OF THE INVENTION

The embodiments of the present invention will now be explained with reference to the figures.

Figure 1:
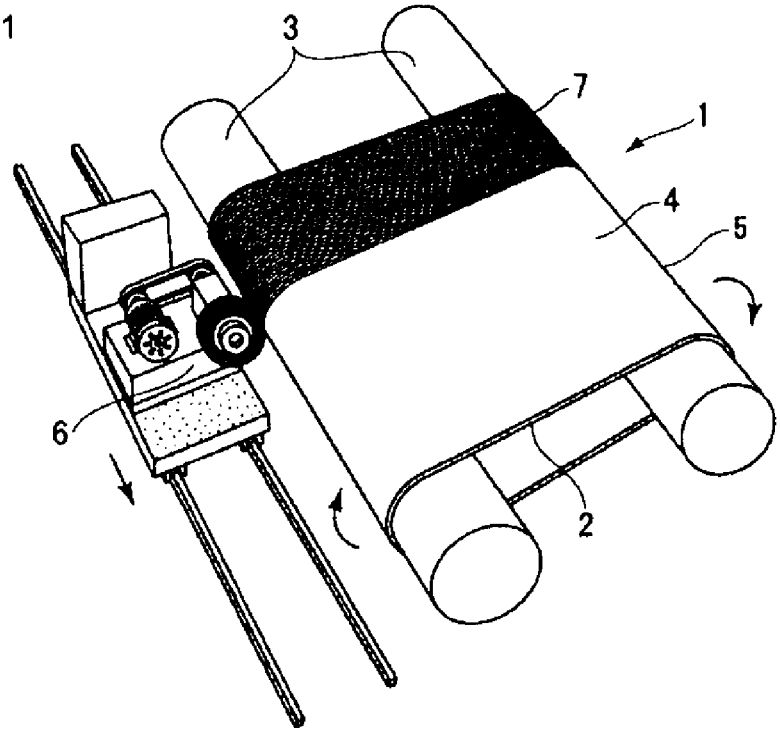
FIG. 1 is a water drain groove forming device for forming the water drain grooves of a shoe press belt according to the present invention.

FIG. 1 is a schematic diagram of device 1 for forming (cutting) the water drain grooves of a shoe press belt for papermaking according to the present invention.

Firstly, an endless substrate 2 is placed around two rolls 3, 3 and stretched with a prescribed force. This roll 3 can rotate and the substrate 2 travels in the direction of rotation of the roll 3. Under such conditions liquid polyurethane is coated from above the substrate 2, which hardens and forms a polyurethane layer 4 over the entire periphery of the substrate 2. Then, a groove cutting device 6 is used to form water drain grooves 7 on the external peripheral surface 5 of the substrate 2 on which the polyurethane layer 4 has been provided.

Figure 2:
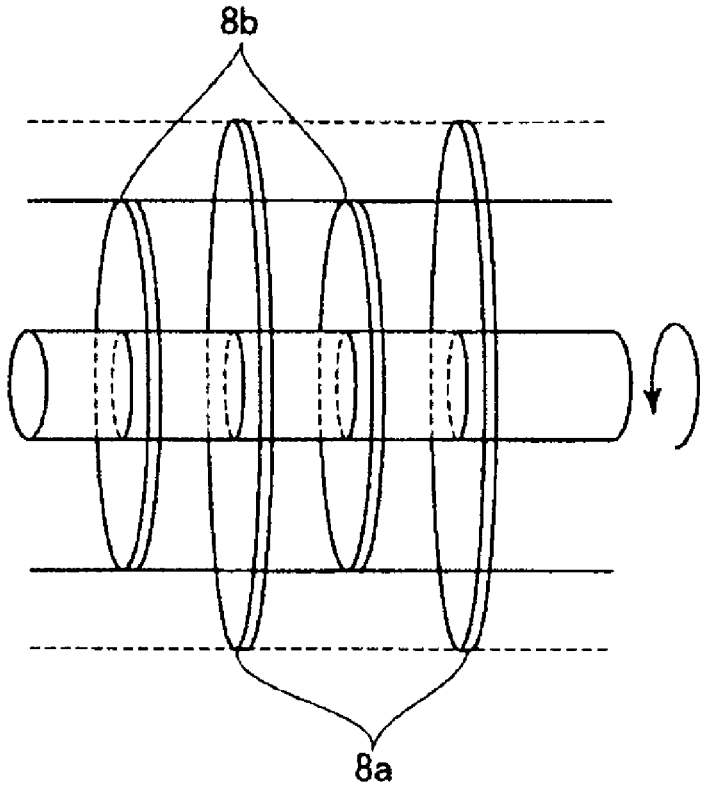
FIG. 2 is a view explaining the arrangement of the cutting blades used for forming the grooves according to the present invention.

Cutting blades wherein cutting blades 8*a*, 8*b* for cutting grooves are arranged, as shown in FIG. 2, are installed in the groove cutting device 6.

Figure 3:
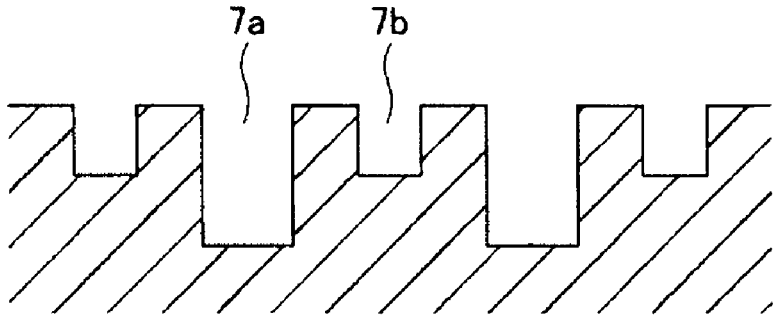
FIG. 3 is a sectional view in the CMD direction showing a first embodiment of groove shapes according to the present invention.
Figure 4:
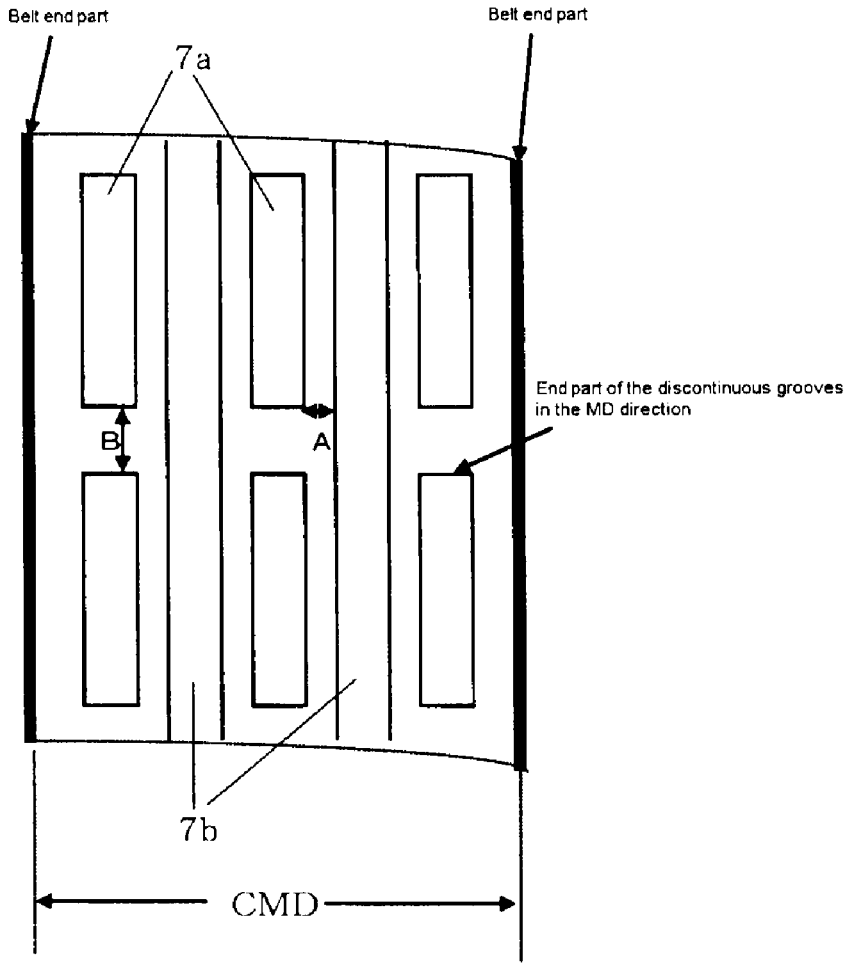
FIG. 4 is a plan view of the external peripheral belt surface also showing the first embodiment of groove shapes according to the present invention.

Regarding the groove shapes of the present invention, to start with, examples of the first embodiment are shown in FIGS. 3 and 4. FIG. 3 is a sectional view in the CMD direction of a shoe press belt for papermaking according to the present invention. FIG. 3 shows a constitution of two types of grooves comprising deep grooves 7*a* and shallow grooves 7*b* which are arranged substantially in alternating parallel rows, but both can also be arranged in a prescribed pattern.

FIG. 4 is a plan view of the external peripheral surface of the shoe press belt for papermaking according to the present invention. In FIG. 4, the A region indicates the CMD direction land part of the water drain grooves, while the B region indicates the MD direction land part of the water drain grooves. In the present invention, adjacent B regions may be in the same phase in the CMD direction as in FIG. 4, or their phases may be shifted at random or aligned at an angle of inclination as shown in FIG. 7.

In the above-mention prescribed pattern, deep grooves (d) and shallow grooves (s) can be combined as follows:

Pattern I: d-s-d-s (one of each type of groove is alternately inserted),

Pattern II: d-ss-d-ss (two shallow grooves are inserted next to one deep groove), Pattern III: dd-s-dd-s (two deep grooves are inserted next to one shallow groove), Pattern IV: dd-ss-dd-ss (two shallow grooves are inserted next to two deep grooves);

these patterns can be suitably used.

These patterns are selected in view of the drainage capacity of the water drain grooves and the surface smoothness of the wet paper web.

Groove dimensions in the following ranges can be adopted; groove width=0.5 to 2 mm, groove depth=0.5 to 2 mm, the space of the land part between adjacent water drain grooves in the CMD direction=0.5 to 5 mm and the space of the land part between adjacent water drain grooves in the MD direction=1 to 20 mm; the void volume of the deep grooves 7*a* and the shallow grooves 7*b* can be formed by suitably adjusting the distance (clearance) between the external peripheral belt surface 5 and the cutting blades 8*a*, 8*b*.

Figure 5:
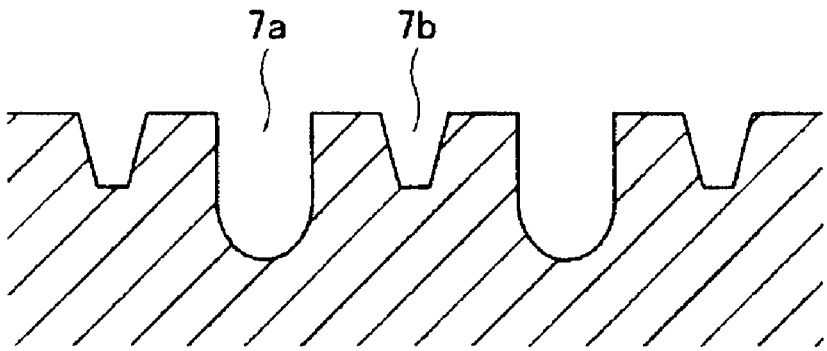
FIG. 5 is another sectional view in the CMD direction also of the first embodiment of groove shapes according to the present invention.

Moreover, the sectional shape of the water drain grooves may be rectangular or trapezoidal, the shape of the groove bottom may be flat or round; or a combination of these shapes may be used. Grooves with a sectional shape in the form of the letter U have a round bottom. FIG. 5 is an example wherein the deep grooves 7*a* are in the form of the letter U, in other words, the sectional shape is in the form of the letter U and the shape of the groove bottom is round, while the shallow grooves 7*b* are in the form of a trapezoid (the sectional shape is in the form of a trapezoid and the shape of the groove bottom is flat).

When combining deep grooves and shallow grooves in the present invention, it is possible to adjust the balance between anti-cracking properties and the drainage capacity of the water drain grooves and the surface smoothness of the wet paper web by forming the one as a continuous groove and the other as a discontinuous groove.

Moreover, it is preferred that the depth inside the discontinuous grooves changes continuously in the MD direction and that the boundary part is in the form of a tapered shape in which the thickness is gradually reduced.

In the present invention, the drainage effect of the water drain grooves is greatly improved when the deep grooves are discontinuous grooves and the shallow grooves are continuous grooves while, on the other hand, the surface smoothness of the wet paper web is deteriorated due to the characteristic marking properties when the arrangement pattern of the CMD direction land parts and the MD direction land parts around the discontinuous grooves is transferred to the wet paper web. When, to the contrary, the deep grooves are continuous grooves and the shallow grooves are discontinuous grooves, it is possible to improve the surface smoothness of the wet paper web while at the same time improving the water drainage effect of the belt grooves to a certain degree.

Furthermore, it has been experimentally confirmed that there is a good balance between the drainage capacity of the water drain grooves and the surface smoothness of the wet paper web when the continuous grooves and the discontinuous grooves are formed with the same depth as in a variation of the first embodiment.

Figure 6:
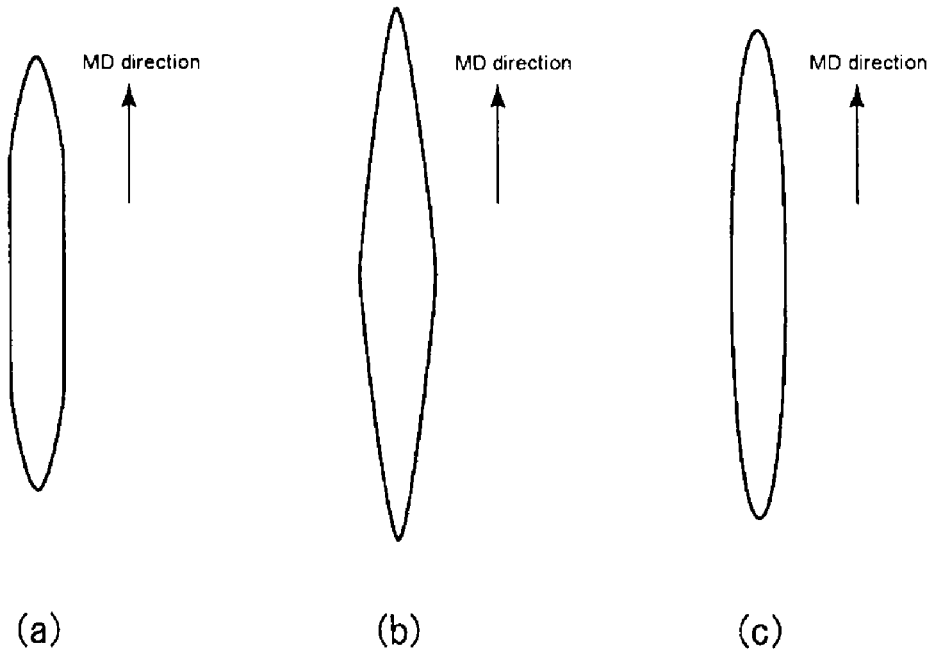
FIG. 6 is a plan view showing a second embodiment of the groove shapes according to the present invention.

Next, regarding the groove shapes according to the present invention, examples of the second embodiment are shown in the plan view of FIG. 6. With these groove shapes it is possible to reduce the deformation due to the force applied at both end parts in the MD direction because the discontinuous grooves are tapered at both end parts.

When the water drain grooves pass the press nip, the polyurethane layer of the belt is compressed and deformed so that the groove width becomes narrower. Due to this deformation, the discontinuous grooves are deformed so that the central part in the MD direction becomes narrower; as a consequence, this deformation propagates to both MD direction end parts of the water drain grooves and cracks may occur at these end parts. However, when the groove shape is tapered at both end parts in the MD direction, as in the examples of the second embodiment according to the present invention, this deformation is alleviated and, since the deformation becomes smaller, the occurrence of cracks at both end parts can be reduced, which has been experimentally confirmed.

Regarding further groove shapes according to the present invention, examples of the third embodiment are shown in FIG. 7. In FIG. 7-*a*, the discontinuous grooves, provided in the CMD direction in parallel rows, are arranged in the MD direction so as to be shifted in relation to each other. FIG. 7-*b* is a variation of the third embodiment; in this conceptual example of the embodiment, these water drain grooves are discontinuous grooves provided in the CMD direction in parallel rows and arranged in the MD direction so as to be shifted in relation to each other, wherein the grooves have, however, different lengths in the MD direction which are set at a variable value.

Next, in the examples of the fourth embodiment, the groove shape according to the present invention can be suitably selected from among groove shapes in which the groove length of the discontinuous grooves in the MD direction is shorter than the width of the press shoe, groove shapes in which the groove length of the discontinuous grooves in the MD direction is equal to the width of the press shoe, and groove shapes of long discontinuous grooves in the range of up to two times the width of the press shoe.

In the case of a groove shape wherein the groove length of the discontinuous grooves in the MD direction is shorter than the width of the press shoe, the discontinuous grooves have the effect of preventing the reverse flow of water at the nip entrance and of receiving the water below the nip, whereby the forcible dewatering function (water drainage capacity) is further improved by the action of the pressure at the exit. However, since the pressure of the water retained inside the water drain grooves is too high, a reverse flow of water (backwater) may occur at the nip entrance when the papermaking machine is operated in the high speed region; therefore, the paper quality (the wet paper web profile) may be put into disarray and, as a result of this, the surface smoothness of the wet paper web may be reduced.

When the groove length of the discontinuous grooves in the MD direction is equal to the width of the press shoe, or in the case of a groove shape of long discontinuous grooves in the range of up to two times the width of the press shoe, even though the water drainage capacity of the discontinuous grooves deteriorates slightly, it is possible to improve the paper quality (wet paper web profile) because backwater does not occur even when the papermaking machine is operated in the high speed region. Consequently, in the present invention it is possible to optimize the balance between the water drainage capacity and the paper quality (surface smoothness of the wet paper web) by adjusting the groove length of the discontinuous grooves in the MD direction in tune with the operating speed of the papermaking machine.

Figure 8:
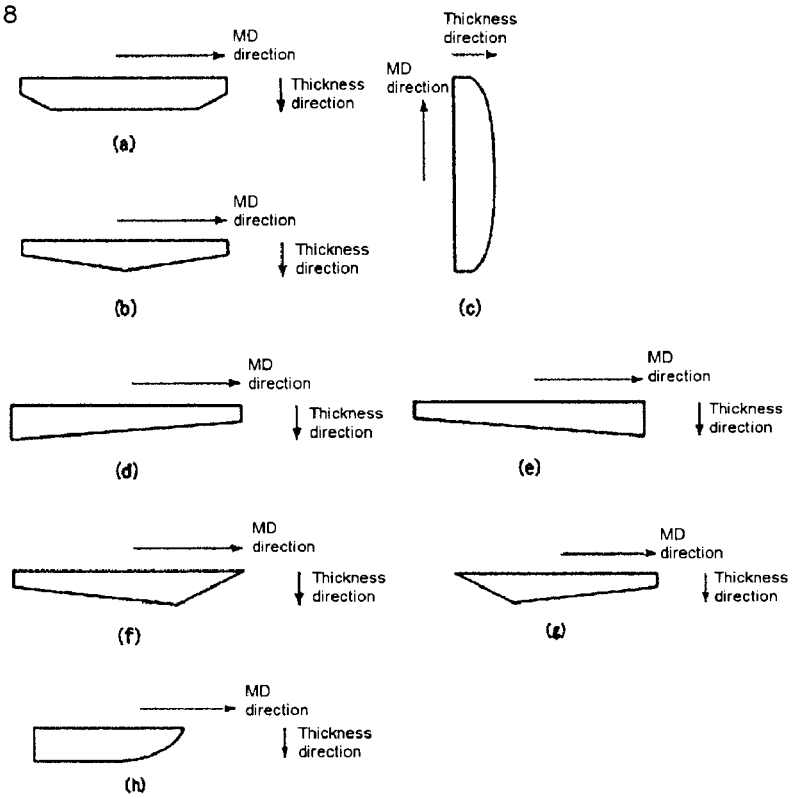
FIG. 8 is a plan view showing examples of a fifth embodiment of the groove shapes according to the present invention.

Regarding still further groove shapes according to the present invention, examples of the fifth embodiment are shown in the plan view of FIG. 8. Any of these groove shapes, in which the groove depth of one end part of the discontinuous grooves in the MD direction is deeper than the groove depth of at least the other end part in the MD direction in the same groove, or the groove depth of the central part of the discontinuous grooves is deeper than the groove depth of at least one end part in the MD direction in the same groove, may be suitably selected.

In this way it is possible to adjust the deformation applied in the depth direction of the groove by forming the groove depth at the end parts in the MD direction differently than at other parts in the same groove. In other words, when the discontinuous grooves pass the press nip, the polyurethane layer of the press belt is compressed and deformed so that the groove depth becomes shallower. The further away from the land part in the MD direction, the bigger the degree of this deformation; therefore, the biggest deformation of the section of the discontinuous grooves occurs at the central part. Consequently, in order to maintain the water holding capacity of the groove, it is preferred to make the depth of the central part of the groove, where the amount of deformation is big, greater then the depth of at least one of the end parts in the MD direction. Moreover, in order to reduce the deformation applied on the groove, the groove shape is preferably symmetrical in front-back.

Moreover, in order to reduce the flow resistance at the press exit and easily eject the retained water, the front end part in the MD direction is preferably deeper than the central part of the discontinuous groove, or it is curved at an inclination.

As mentioned above, the MD direction groove length of the discontinuous grooves according to the present invention is preferably shorter than the width of the press shoe (the MD direction length of the shoe) because the greatest force, which is very strong, occurs due to a water volume retained in a closed groove. Shoe presses for the press part of a papermaking machine come in many different widths; however, most are in the range of about 50 to 400 mm; therefore, the MD direction groove length of the discontinuous grooves according to the present invention is set shorter than the press shoe width within the range of 40 to 390 mm; while the width of long discontinuous grooves equal to the width of the press shoe or in a range of up to two times the width of the press shoe can be set in the range of 50 to 800 mm.

In the present invention, it is possible to form the water drain grooves in the MD direction into continuous or discontinuous grooves by suitably adjusting the distance between the external peripheral surface of the belt and the cutting blades. In the case of discontinuous grooves, the cutting is performed by pulling and pushing, and the like, the cutting blades with a thickness adjusting motor at fixed time intervals. It is also possible to perform the cutting by rotating fixed blades in an elliptical orbit.

Moreover, in case the water drain grooves are formed in the belt surface by a single cutting process, cutting blades of different radii are arranged alternately or in a prescribed pattern (FIG. 2). In case the grooves are formed in two cutting processes, firstly the cutting blades with a small radius are set and the grooves with a shallow depth are cut, then the cutting blades with a big radius are set and the grooves with a deep depth are cut in the space between the grooves with a shallow depth.

By chamfering the end parts of the land part where no grooves are formed, damage and broken edges of the end parts can be avoided.

(Performance Evaluation Method)

The performance of the shoe press belts produced in the Examples of the present invention was evaluated by the tests hereinafter, and the overall evaluation was performed by attributing a ranking.

(Crack Test)

Figure 11:
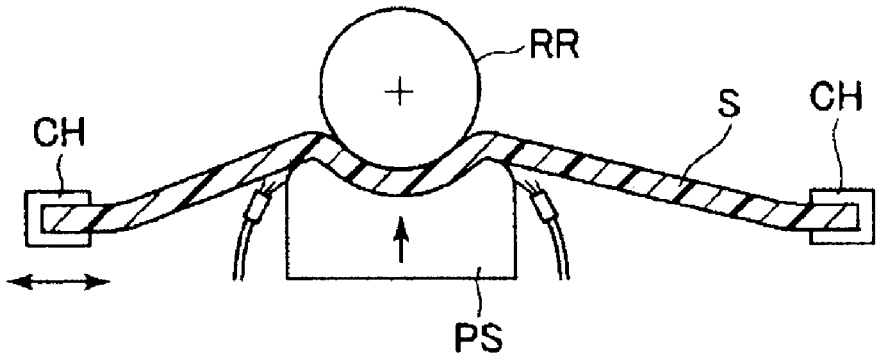
FIG. 11 is a view showing a device used for crack testing.

The device shown in FIG. 11 was used. In this device, both ends of a specimen S are pinched by crank hands CH, CH; the crank hands CH, CH are configured so that they can move in unison back and forth in the left/right direction. Moreover, the force applied on the specimen S was 3 kg/cm; and the speed of the back and forth movement was 40 cm/sec. The specimen S was pressed by the press roll RR and the press shoe PS. Then, the specimen S was pressed by the displacement of the press shoe PS in the direction of the press roll RR. The pressing force moreover was 36 kg/cm$^2$. This device measures the frequency of the back and forth movement until cracks occur. Furthermore, the evaluation surface of the specimen was the side facing the press roll RR. The frequency until cracks occur was:

Evaluation score A: 260,000 times or more, Evaluation score B: in the range between 120,000 and 260,000 times, Evaluation score C: 120,000 times or less.

(Water Squeezing Test)

Figure 12:
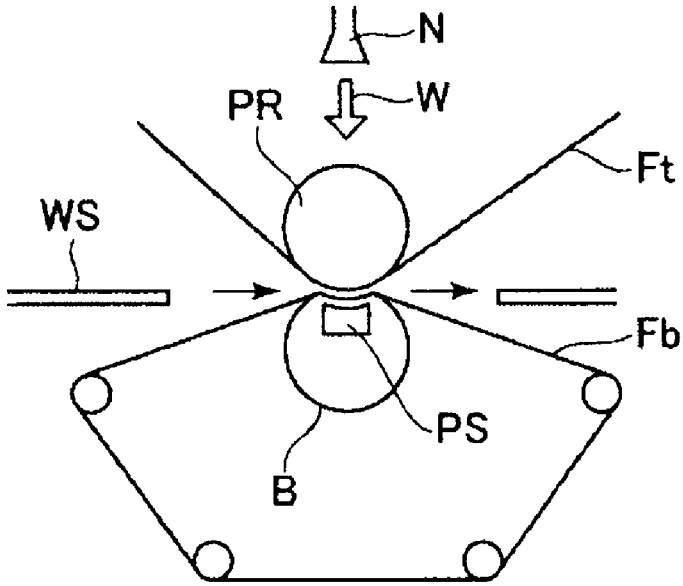
FIG. 12 is a schematic diagram of a water squeezing test.

The water squeezing test of the wet paper web was performed by using the device shown in FIG. 12. In the present test device, the belt B was placed in a position facing the press roll PR, and the press shoe PS (shoe width; 50 mm) was placed so as to press the belt B against the press roll PR from the internal periphery of said belt. Furthermore, a top felt Ft and a bottom felt Fb, both of which were made by integrating (flocking) a staple fiber of 11 dtex nylon 6 with a base fabric by needle punching so as to obtain a basis weight of 1500 g/m$^2$, were placed between the press roll PR and the belt B.

Then the belt B ran at a traveling speed of 1000 m/min. under a nip pressure of 1000 kN/m between the press roll PR and the press shoe PS. After which a water flow W was ejected from a nozzle N installed above the press roll PR at a pressure of 3 kg/cm2 and a rate of 15 liters/min. At that time, the top roll was covered by a film from the water flow W, and after penetrating the top felt Ft and the bottom felt Fb, the water flow W also reached the belt B. Under such conditions a wet paper sheet WS having 70% moisture content was placed on the bottom felt Fb and passed through the nip; after passing the nip, the moisture content of the wet paper sheet WS was measured. The wet paper web moisture content was:

Evaluation score A: 45% or less,

Evaluation score B: in the range between 45% and 53%,

Evaluation score C: 53% or more.

(Wet Paper Web Marking Properties Test)

(1) The wet paper web which was squeezed in the above-mentioned water squeezing test was dried by storing it in a dryer at 50° C. for 24 hours; thereafter, pictures were taken of the surface of the dried paper.

(2) The images were scanned into a computer. Then, suitable processing was performed to render the images clearer. The "Photoshop 5" software from Adobe and the like was used for scanning in the images.

(3) The groove part area (groove marks) transferred to the dried paper was calculated by an image processing software. The "NIH Image" software from the National Institute of Health was used for the image treatment.

(4) The ratio of the groove part area (groove marks) transferred to the dried paper to the area of the external belt surface was calculated by using such image treatment software.

Evaluation score A: 50% or less,

Evaluation score B: in the range between 50% and 75%,

Evaluation score C: 75% or more.

(Ranking)

Regarding the test results, the overall evaluation was performed based on the respective evaluation scores of the above tests, and the ranking was attributed as follows:

All evaluation scores were A: Ranking 1

Two evaluation scores were A and the others were B: Ranking 2

One evaluation score was A and the others were B: Ranking 3

All evaluation scores were B: Ranking 4

One of the evaluation scores was C: Ranking 5

Regarding the shoe press belts of the above-mentioned constitution, specifically, the shoe press belts of Examples 1 to 9 and of Comparative Example 1 were produced by the processes described hereinafter.

Process 1: the device shown in FIG. 1 was used; an endless substrate was engaged between 2 rolls and stretched with a prescribed force.

Process 2: liquid polyurethane was applied from above the substrate, which hardens and forms a polyurethane layer 4 over the entire periphery of the substrate.

Process 3: cutting blades 8*a* for cutting the deep grooves and cutting blades 8*b* for cutting the shallow grooves were respectively installed in the groove cutting device. The shape of these cutting blades was selected so that the sectional groove shape becomes rectangular. The continuous grooves and the discontinuous grooves were cut in two cutting processes so as to be provided in alternating parallel rows. The present invention is, however, not limited to these processes.

The groove shapes of the continuous and discontinuous grooves according to the present invention were adjusted as follows:

(1) Groove width: adjusted to 1.2 mm.

(2) Groove depth: the deep grooves were adjusted to 1.5 mm and the shallow grooves to 0.8 mm.

(3) Width of the land part in the CMD direction: adjusted to 1.5 mm.

(4) Width of the land part in the MD direction: adjusted to 5.0 mm.

(5) Length of the discontinuous grooves in the MD direction: adjusted to 40 mm (shorter than the press shoe PS width of 50 mm in the test device of FIG. 12).

EXAMPLE 1

The cutting blades 8*a* for cutting the deep grooves and the cutting blades 8*b* for cutting the shallow grooves were respectively installed in the cutting device so as to form the groove shapes of FIG. 3. In this case, the deep grooves were cut so as to become discontinuous grooves and the shallow grooves were cut so as to become continuous grooves.

EXAMPLE 2

This Example is identical to Example 1 except that in this case the deep grooves were cut so as to become continuous grooves and the shallow grooves were cut so as to become discontinuous grooves.

EXAMPLE 3

Only the cutting blades 8*a* for cutting the deep grooves were installed in the cutting device so as to form the groove shapes of the continuous grooves and the discontinuous grooves with the same groove depth.

EXAMPLE 4

In Example 4, discontinuous grooves with the same groove shape as in Example 3 were shifted by 5 mm (this length is identical to the length of the land part) in relation to each other in the MD direction so as to be provided in the CMD direction in parallel rows as in FIG. 7-*a*.

EXAMPLE 5

In Example 5, the groove lengths in the MD direction of discontinuous grooves, which had the same groove shape as in Example 3, were provided at random (as in FIG. 7-*b*) at a variable value in the range between 20 mm to 40 mm, which is shorter than the shoe width of 50 mm.

EXAMPLE 6

Figure 9:
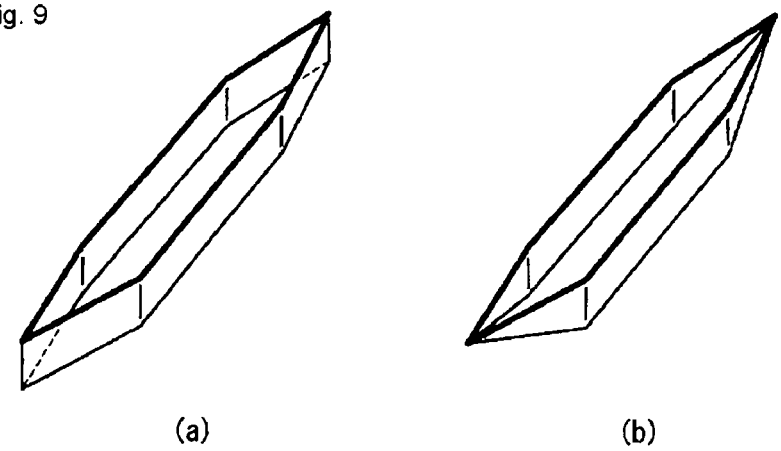
FIG. 9 is a three-dimensional view showing examples of the second embodiment of the groove shapes according to the present invention.

Only the cutting blades 8*a* for cutting the deep grooves were installed in the cutting device so as to form the groove shapes of the discontinuous grooves in FIG. 6 which are tapered at both end parts in the MD direction. When the discontinuous grooves were cut, fixed blades were rotated in an elliptical orbit so as to form a groove shape which is shallow and tapered at both end parts (like the so-called "boat shape" in FIG. 9-*b*). The groove shapes of the discontinuous grooves in Example 6 are shown in the three-dimensional views of FIG. 9.

EXAMPLE 7

Figure 10:
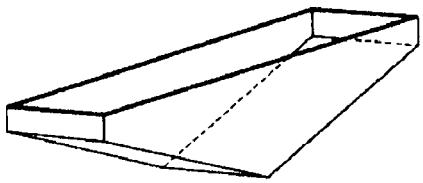
FIG. 10 is a three-dimensional view showing examples of the fifth embodiment of the groove shapes according to the present invention.

In order to form discontinuous grooves as in FIG. 8-*b*, the cutting was performed by pulling and pushing the cutting blades 8*a* for the deep grooves with a thickness adjusting motor at fixed time intervals. In this case, the groove shape of the discontinuous grooves is deeper at the central part in the MD direction than at both end parts in the MD direction. The groove shape of the discontinuous grooves in Example 7 is shown in the three-dimensional view of FIG. 10.

EXAMPLE 8

In Example 8, the length in the MD direction of the discontinuous grooves, which had the same groove shape as in Example 7, was adjusted to 50 mm, which is identical to the press shoe width of 50 mm in the present test device.

EXAMPLE 9

In Example 9, the length in the MD direction of the discontinuous grooves, which had the same groove shape as in Example 7, was adjusted to 80 mm, which is longer than the press shoe width of 50 mm in the present test device.

COMPARATIVE EXAMPLE

Only the cutting blades 8*a* for cutting the deep grooves were installed in the cutting device so as to form continuous grooves with a general rectangular shape. Continuous grooves, whose groove shape was aligned in the MD direction, were formed in the CMD direction in parallel rows by this cutting.

Regarding the shoe press belts relating to Examples 1 to 9 and Comparative Example 1, crack tests, water squeezing tests, and wet paper web marking property tests were performed and the performance was evaluated. The results thereof are shown in Table 1.

TABLE 1

| No. | Crack test score | Water squeezing test score | Wet paper web marking properties test | Ranking |
|---|---|---|---|---|
| Example 1 | B | A | B | 3 |
| Example 2 | B | B | A | 3 |
| Example 3 | B | B | B | 4 |
| Example 4 | B | B | A | 3 |
| Example 5 | B | A | A | 2 |
| Example 6 | A | A | A | 1 |
| Example 7 | A | A | B | 2 |
| Example 8 | A | A | B | 2 |
| Example 9 | A | B | A | 2 |
| Comparative Example 1 | B | C | A | 5 |

According to the results of Table 1, good evaluations were obtained in all three evaluation tests with the grooves of Example 6, which are the grooves with the best balance.

[Industrial Applicability]

The shoe press belt according to the present invention is most useful for improving the water squeezing capability from a wet paper web and a felt in the press part of a papermaking machine or another similar machine because it can improve, at the same time, the water drainage capacity and the paper quality (surface smoothness of the wet paper web).

The invention claimed is:

1. A shoe press belt for papermaking carrying a felt which absorbs water squeezed from a wet paper web, wherein two or more water drain grooves extend in a machine running direction (MD direction) in a felt side surface of said shoe press belt for papermaking and wherein said two or more water drain grooves include continuous grooves and discontinuous grooves, and the continuous grooves and the discontinuous grooves are substantially provided in alternating parallel rows.

2. The shoe press belt for papermaking according to claim 1, wherein the two or more water drain grooves have at least two or more types of groove shapes of different groove width and/or groove depth each respectively in a cross machine direction (CMD direction).

3. The shoe press belt for papermaking according to claim 1, wherein the continuous grooves are deep grooves and the discontinuous grooves are shallow grooves.

4. The shoe press belt for papermaking according to claim 1, wherein the continuous grooves are shallow grooves and the discontinuous grooves are deep grooves.

5. The shoe press belt for papermaking according to claim 1, wherein the continuous grooves and the discontinuous grooves have the same groove depth.

6. The shoe press belt for papermaking according to claim 1, wherein the groove shape is tapered at both end parts of the discontinuous grooves.

7. The shoe press belt for papermaking according to claim 1, wherein the discontinuous grooves are provided in the cross machine direction (CMD direction) in parallel rows and are arranged at an equal spacing in the MD direction so as to be shifted in relation to each other.

8. The shoe press belt for papermaking according to claim 1, wherein a groove length of the discontinuous grooves is shorter than a width of a press shoe.

9. The shoe press belt for papermaking according to claim 1, wherein a groove length of the discontinuous grooves is equal to a width of a press shoe or within a range of up to two times the width of the press shoe.

10. The shoe press belt for papermaking according to claim 1, wherein a groove depth at one end part of the discontinuous grooves is greater than a groove depth at the other end part.

11. The shoe press belt for papermaking according to claim 1, wherein a groove depth at the central part of the discontinuous grooves is greater than a groove depth of at least one end part.

* * * * *